United States Patent [19]

Amron

[11] Patent Number: 4,739,993

[45] Date of Patent: Apr. 26, 1988

[54] ELECTRICALLY-POWERED TOSS GAME

[76] Inventor: Scott L. Amron, 90 Rodeo Dr. - Oyster Bay Cove, Syosset, N.Y. 11791

[21] Appl. No.: 56,061

[22] Filed: Jun. 1, 1987

[51] Int. Cl.[4] ..... A63B 67/00

[52] U.S. Cl. ..... 273/324; 273/412; 273/DIG. 30

[58] Field of Search ..... 273/324, 412, 414, 179 A, 273/179 B, DIG. 17, DIG. 18, DIG. 19, 399, 400, DIG. 30

[56] References Cited

U.S. PATENT DOCUMENTS

| | | | |
|---|---|---|---|
| 286,868 | 10/1883 | Thompson | 273/399 |
| 2,617,651 | 11/1952 | Gerhold | 273/324 |
| 3,471,150 | 10/1969 | Kaerwer | 273/179 A X |
| 4,266,778 | 5/1981 | Sine | 273/324 |
| 4,303,247 | 12/1981 | Fain | 273/324 |

*Primary Examiner*—William H. Grieb
*Attorney, Agent, or Firm*—Gerard F. Dunne

[57] ABSTRACT

An electrically powered device for tossing and catching a ball includes a cup portion configured to receive the ball and having an internal push member which can be reciprocated within the cup portion. Both the push member and the ball preferably are coated with Velcro material to hold the ball to the push member, and a coil spring is provided between the push member and the bottom wall of the cup portion to urge the push member in an upward position adjacent the open end of the cup portion. A solenoid or other electrically-powered device is provided for retracting the push member within the cup portion to enable a user to catch the ball within the cup portion, and a latching bar is provided to hold the push member in its retracted position. Additionally, a switch is provided to withdraw the latching bar from its engagement with the push member after catching the ball so the ball can be forcibly ejected from the cup member by the action of the coil spring. In this way, the device can be used to toss a Velcro-covered ball towards a playmate having a comparable device for catching the tossed ball and thereafter the playmate can activate the switch on his device to return the Velcro-covered ball.

12 Claims, 1 Drawing Sheet

ELECTRICALLY-POWERED TOSS GAME

The present invention relates to an electrically-powered device for tossing and catching an object such as a spherical ball, and it is envisioned that separate devices could be used by two children to play a toss-and-catch game.

Various games for tossing and catching an object between two players are well known, and typically these games require a ratchet or other hand-powered means to propel the object between the players. It is, however, an object of the present invention to provide a toss game which uses an electrically-powered assist to forcibly propel the tossed object, and in this way, add a new dimension to the play of a toss game.

Accordingly, an electrical powered device for tossing and catching an object is provided which includes a cup portion adapted to receive the object and preferably having handle portions extending oppositely from the cup portion. Each of the handle portions is adapted to be held in a respective hand of the user, and the cup portion is dimensioned to receive the tossed object which is preferably a weighted ball. The cup portion includes a push member which can reciprocate within the cup portion, and a coil spring is provided for urging this push member towards the open end of the cup portion. Means which preferably include a solenoid are provided for retracting the push member electrically into a retracted position towards the closed end of the cup portion, and in this way the solenoid can be activated to enable the user to catch the tossed object within the cup portion.

Preferably, the tossed object and the push member are coated with matching Velcro material to enable the tossed object to be held securely within the cup portion after a catch is made by the user of the device.

After the catch of the tossed object, the tossed object can be forcibly ejected from the cup member by releasing the push member from its retracted position. Preferably, two switches are provided which are located in the respective handle portions, and one of the switches is used to activate the electrically-powered solenoid to retract the push member within the cup portion; and thereafter the second switch can be actuated by the user to release the push member to eject the tossed object.

The push member can be held in its retracted position by any of several structures, and it is preferred that a latching bar be provided within the handle having the ejecting switch, and this latching bar will serve to mate with co-acting structures on the push member to hold the push member in its retracted position. Thereafter, actuation of the ejecting switch will retract the latching bar from the push member to release the push member and forcibly eject the tossed object by the previously-compressed coil spring.

These and other objects, features and advantage of the present invention will be made more apparent from the detailed description of a preferred embodiment thereof made in conjunction with the attached drawings, in which.

Figure 1:
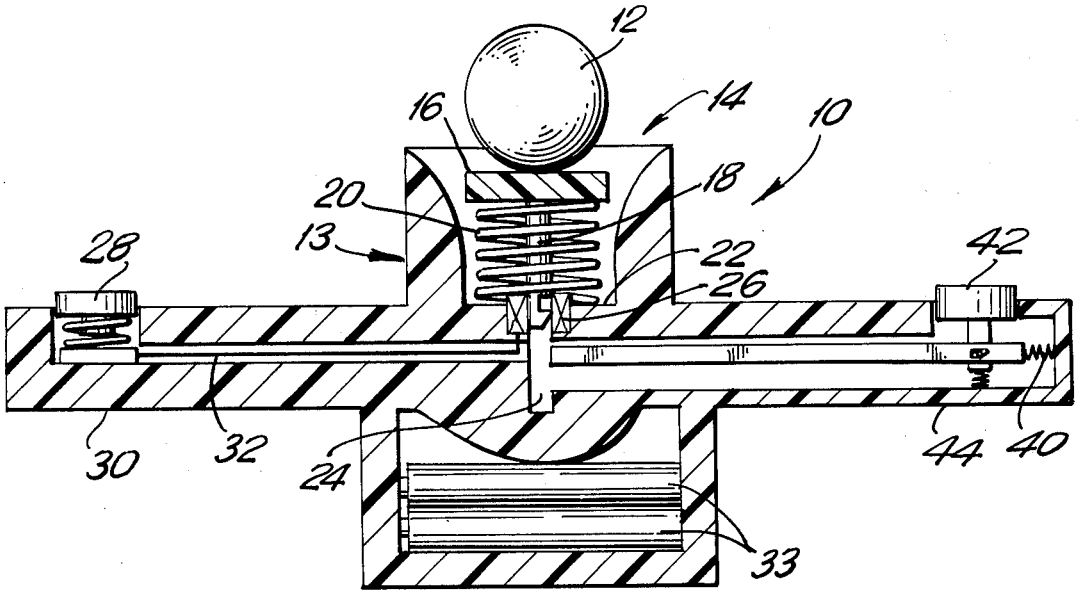
FIG. 1 is a cross sectional view of an embodiment of the present invention.

FIG. 1 is a schematic illustration of a device incorporating the features of the present invention, and FIG. 1 illustrates a device 10 capable of catching and forcibly ejecting the ball 12. It is understood that two devices 10 would be provided for playing the game between playmates, and each of the playmates would have an identical device 10. Alternatively, the device could be used singularly by one user who could toss the ball 12 into the air for catching it upon its return.

As illustrated in FIG. 1, the device 10 includes a circular cup portion 13 having a push member 14 formed of a disc-shaped plate portion 16 and a depending rod portion 18. Preferably, both the ball 12 and the plate portion 16 are coated with Velcro or other hook-and-loop material for enabling the plate portion 16 to securely hold the ball 12.

Centered around the rod portion 18 of the push member 14 is a coil spring 20 which is held between the underside of the plate portion 16 and the bottom wall 22 of the cup portion 13.

The coil spring 20 serves to urge the push member upwardly towards the open end of the cup portion 13, and extending through the bottom wall 22 of the cup portion 13 is a passageway 24 adapted to receive the lower end portion of the rod portion 18 of the push member. A stop, not shown, is provided in the passageway 24 to ride in a groove in the lower portion of the rod member to prevent the rod member from sliding fully out of the passageway.

Situated within the lower portion of the device 10 is an electrically-powered device such as a solenoid 26 which can be activated by depressing a push button 28 in one handle portion 30 extending from the cup portion 13. Depressing the push button 28 serves to close an electrical circuit including the wiring 32 and batteries 33 to energize the solenoid and forcibly withdraw the push member 14 towards the bottom of the cup member 13 against the resilience of the coil spring 20.

Figure 2:
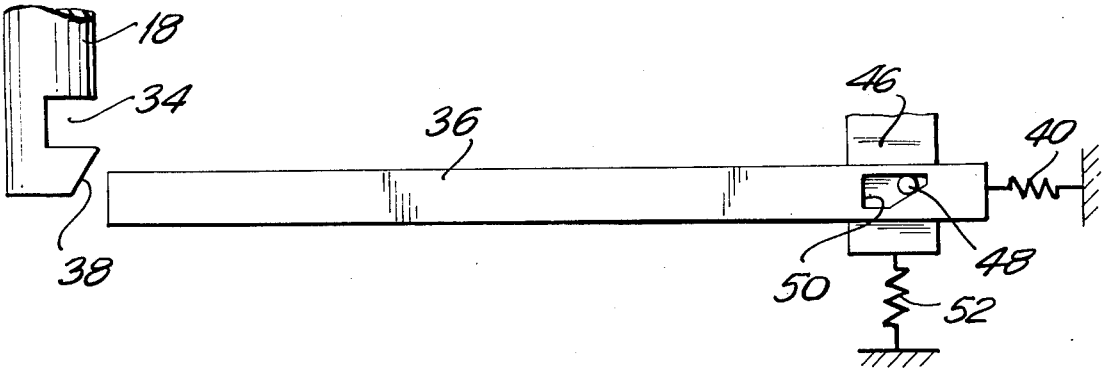
FIG. 2 is a schematic illustration of the latching structures used to hold the push member in its retracted position.

Below the cup member 13 are provided structures for securely latching the lower end of the rod portion 18 in the retracted position of the push member, and preferably as illustrated schematically in FIG. 2, these latching means include a notch 34 formed within the lower end portion of rod portion 18 and a latching bar 36 which has structures on its forward end mating within the notch 34. As illustrated in FIG. 2, the lower surface of the rod portion 18 has a camming surface 38 which upon lowering of the rod portion within the passageway 24 serves to urge the latching bar 36 rightwardly in FIG. 2 against the action of spring 40 until the notch 34 is aligned with the forward end of the latching bar 36. At this time, the forward end of the latching bar 36 will snap within the notch 34 to hold the push member 14 in its retracted position in the lower portion of the cup member 13.

In this position, the user of the device may catch the ball 12 within the cup member 13. At the election of the user, the push member 14 can be released forcibly to eject the ball 12 from the cup member by actuation of a push button switch 42 in the other handle portion 44 of the device.

As illustrated in FIG. 2, co-acting structures are formed respectively on the push button 42 and the latching bar 36 so as to withdraw the latching bar 36 against the resilience of spring 40 from the notch 34. Such co-acting structures may take any of several forms, and as illustrating schematically in FIG. 2, includes a depending portion 46 of the push button 42 having an orthogonally projecting nub 48 which rides within cam grove 50 of the latching bar. A spring element 52 is provided to urge the element 46 upwardly, and upon depressing of the push button 42, the element 46 is urged downwardly to cause the nub 48 to ride with cam grove 50 to draw the latching bar 36 towards the right as shown in FIG. 2.

It is, however, understood that other means for electrically withdrawing the push member 14 into its retracted position and later releasing the push member to forcibly eject the ball 12 could be provided. For example, an electric motor can be provided below the cup portion 13 instead of the solenoid 26, and this electric motor could include a screw shaft which can be rotated to withdraw the rod portion 18 of the push member. Additionally, a mechanical latch that can be activated electrically such as by a solenoid could also be provided instead of the latching bar with its mechanical retraction illustrated in FIG. 2.

As can be understood from the foregoing, the device of the present invention includes handle portions with a centered cup portion for catching and tossing a spherical object such as a weighted ball, and preferably the handle portions extend oppositely from the cup portion so that they can be readily grasped and held by the user of the device, even if the user is a rather young child. By actuating one of the push buttons on the handle portions, the push member within the cup portion is retracted under electrical power to enable the user to catch the ball 12 within the cup member; and thereafter a switch in the other handle can be actuated at the election of the user to release the push member from it position and forcibly eject the ball 12 under the power of the coil spring 20.

My invention could take forms other than those illustrated in the embodiment describe herein, and my invention is intended to be defined by the claims appended hereto.

What I claim is:

1. An electrically powered device for tossing and catching an object, comprising a cup portion adapted to receive said object and having a push member adapted to reciprocate therein, spring means urging said push member towards the open end of said cup portion, means for electrically retracting said push member into a retracted position towards the closed end of said cup portion for enabling a user to catch the object within said cup portion, means for holding said push member in said retracted position, and means for releasing said push member from said retracted position to urge said push member forcibly towards said open end of the cup portion by said spring means, including two handle portions extending from said cup portion and each adapted to be held in a respective hand of the user, one of said handle portions including a first switch means for activating said electrically-retracting means and the other of said handle portions having a second switch means for said push member-releasing means.

2. An electrically powered device as set forth in claim 1, wherein said push member and said object are respectively coated with a matching hook-and-loop material for holding said object to said push member.

3. An electrically powered device as set forth in claim 1, said handle portions extending oppositely from said cup portion with said cup portion being centered therebetween.

4. An electrically powered device as set forth in claim 1, said push member having a depending rod portion and said electrically-retracting means including a solenoid located in the closed end of said cup portion and receiving said rod portion for retracting said push member into its retracted position upon activation of said first switch means to activate said solenoid, said spring means including a coil spring extending around said rod portion and held between said closed end portion of said cup portion and said push member.

5. An electrically powered device as set forth in claim 4, including a latching bar having one end adapted to engage a mating portion of said rod portion for holding said push member in said retracted position, and coacting means formed respectively on the other end of said latching bar and said second switch means for releasing said latching bar from holding said rod portion.

6. An electrically powered device for tossing and catching an object, comprising a cup portion adapted to receive said object and having a push member adapted to reciprocate therein, spring means urging said push member towards the open end of said cup portion, means for electrically retracting said push member into a retracted position towards the closed end of said cup portion for enabling a user to catch the object within said cup portion, means for holding said push member in said retracted position, and means for releasing said push member from said retracted position to urge said push member forcibly towards said open end of the cup portion by said spring means, said push member having a depending rod portion and said electrically-retracting means including a solenoid located in the closed end of said cup portion and receiving said rod portion for retracting said push member into its retracted position upon activation of a first switch means, said spring means including a coil spring extending around said rod portion and held between said closed end portion of said cup portion and said push member.

7. An electrically powered device as set forth in claim 6, including a latching bar having one end adapted to engage a mating portion of said rod portion for holding said push member in said retracted position, and coacting means formed respectively on the other end of said latching bar and second switch means for releasing said latching bar from holding said rod portion upon actuation of the second switch means.

8. An electrically powered device for tossing and catching an object, comprising a cup portion having handle portions extending therefrom and each adapted to be held in a respective hand of the user, said cup portion including a push member comprising of a plate portion and a depending rod portion, means including a solenoid adapted to receive the lower portion of said rod portion for withdrawing said push member towards the closed end of said cup portion upon activation of said solenoid for enabling a user to catch the object within said cup portion, means including a coil spring extending between the closed end of said cup portion and said plate portion for urging said plate portion towards the open end of said cup portion, means including a first switch within one of said handle portions for electrically connecting said solenoid to one or more batteries, means including a latching bar extending through the other of said handle portions and having one end adapted to engage a mating portion of the lower end portion of said rod portion for holding said push member in its retracted position upon activation of said solenoid, and means including a second switch within the other of said handle portions for actuating co-acting structures on said second switch and said latching bar for disengaging said latching bar from said rod portion upon actuation of said second switch to forcibly urge said push member towards the open end of said cup portion.

9. An electrically powered device as set forth in claim 8, wherein said object and said push member are respectively coated with mating hook-and-loop material for holding said object to said push member.

10. An electrically powered device as set forth in claim 8, said handles extending oppositely from said cup portion with said cup portion being centered therebetween.

11. An electrically powered device for tossing and catching an object, comprising a cup portion having handle portions extending therefrom and each adapted to be held in a respective hand of the user, said cup portion including a push member adapted to be reciprocated within said cup portion, means for withdrawing said push member into a retracted position by electrical power towards the closed end of said cup portion for enabling a user to catch the object within said cup portion, means including a coil spring extending between the closed end of said cup portion and said push member for urging said push member towards the open end of said cup portion, means including a first switch within one of said handle portions for activating the electrical power for withdrawing said push member into its retracted position, and means including a second switch within the other of said handle portions for releasing said push member from its retracted position.

12. An electrically powered device as set forth in claim 11, wherein said object and said push member are respectively coated with mating hook-and-loop material for holding said object to said push member.

* * * * *